United States Patent [19]

Nitschke

[11] 4,430,004

[45] Feb. 7, 1984

[54] MULTI-FACED CLOCK

[76] Inventor: Noel N. Nitschke, 81 Sherwill St., Feilding, New Zealand

[21] Appl. No.: 353,190

[22] Filed: Mar. 1, 1982

[30] Foreign Application Priority Data

Mar. 12, 1981 [NZ] New Zealand ..... 196485

[51] Int. Cl.[3] ..... G04B 19/06

[52] U.S. Cl. ..... 368/235; 368/222; 368/284

[58] Field of Search ..... 368/235, 222, 46, 39, 368/284, 276

[56] References Cited

U.S. PATENT DOCUMENTS

| | | | |
|---|---|---|---|
| 139,839 | 6/1873 | Wade | 368/235 |
| 2,243,343 | 5/1941 | Johnson | 368/222 |
| 3,184,911 | 5/1965 | Canale et al. | 368/46 |
| 3,910,032 | 10/1975 | Funaki et al. | 368/222 |

FOREIGN PATENT DOCUMENTS

| | | | |
|---|---|---|---|
| 842421 | 6/1939 | France | 368/235 |
| 482863 | 12/1951 | Italy | 368/222 |
| 548140 | 1/1923 | France | 368/235 |

*Primary Examiner*—Bernard Roskoski

*Attorney, Agent, or Firm*—Holman & Stern

[57] ABSTRACT

A clock which includes a member which rotates in a time dependent manner and which has a substantially cylindrical periphery about the axis of generation which has disposed thereabout two axially spaced sets of clockwise sequenced indicia indicative of the time, the two sets being out of phase about the periphery by the angle $\alpha$ with one set having the indicia inverted relative to the other, the member being so arranged within a housing that a sight element disposed about the periphery can indicate on the appropriate indicia the particular time. Ideally the angle $\alpha$ is 180°. The invention also consists of a device to convert a conventional clock to such a multi-faceted display.

4 Claims, 12 Drawing Figures

MULTI-FACED CLOCK

BACKGROUND OF THE INVENTION

1. Field of the Invention
2. Description of the Prior Art

Many forms of clocks are now known. These include (i) mechanical clocks which may for example include a spring which can be wound, a pendulum, or a descending weight, as the power input means, (ii) electric clocks of the kind driven by an electric motor which may include mechanical indicators indicative of the time or have an illuminated or electronic display indicative of the time, and (iii) electronic clocks of a kind where no motor as such is required (e.g. with quartz crystal) with the time being indicated by a liquid crystal display, light emitting diode or if deemed appropriate through some electrical motor which provides a mechanical indication with for example arms.

With whatever form of clock however there is a disadvantage that when placed for example between two beds only one person is in a position ideally suited for viewing the clock. There is therefore some need to provide means and/or methods whereby a clock of which ever kind is envisaged is more convenient for such uses.

It is therefore an object of the present invention to provide a clock of any of the forms previously envisaged or indeed even of another form which includes at least two time displays which will indicate the same time of day and which can be best viewed from different directions.

SUMMARY OF THE INVENTION

The present invention consists in a clock having a substantially cylindrical periphery rotatable about the axis of generation of said periphery in a time dependent manner, said periphery including disposed thereabout two axially spaced sets of clockwise sequenced indicia indicative of the time, the two sets being out of phase about the periphery by the angle $\alpha$ with one set having the indicia inverted relative to the other. A viewing window is provided substantially at positions angle $\alpha$ apart show on a particular set of indicia the time, the arrangement being such that the same time is indicated by both windows.

Preferably the substantially cylindrical periphery is rotated by a shaft which also actuates the hour hand of a clock face.

Preferably said shaft rotates said cylindrical surface by a direct coupling of said cylinder to an extension of said hour hand.

Preferably angle $\alpha$ is 180°.

Preferably the window for indicating the time on each of the sets of indicia about the substantially cylindrical face is a window arrangement in a housing for the the cylindrical face.

In a further aspect the present invention consists in a rotatable element for incorporation in a clock so as to provide at least two sets of indicia in a clock having a substantially cylindrical periphery about the axis of generation of the periphery in a time dependent manner, including disposed thereabout two axially spaced sets of clockwise sequenced indicia indicative of the time, the two sets being out of phase about the periphery of the angle $\alpha$ with one set having the indicia inverted relative to the other. Windows are provided substantially at positions angle $\alpha$ apart to show on a particular set of indicia the time, the arrangement being such that the same time is indicated by both windows. The rotatable element is a cylinder and defines a substantially cylindrical face having disposed axially apart two circumferentially extending sets of numerals, Arabic, Roman or notational, such that while both sets sequence clockwise, one of the sequences is out of phase with the other and has its numerals inverted relative to the other.

Preferably the sequences are out of phase by 180°.

BRIEF DESCRIPTION OF THE DRAWINGS

Preferred forms of the present invention will now be described with reference to the accompanying drawings in which.

DETAILED DESCRIPTION OF THE INVENTION

The present invention in its preferred form is a three in one clock which will provide a much more convenient method of seeing the time such that the time of day can be seen from any one of three directions. The clock is useful for placing on a table for example between two beds.

It can be seen from the preferred embodiments as depicted in the figures the invention is an extension of a single clock in the sense that a mechanical hand display is used in conjunction with a rotating cylinder or drum which can display the time through exposed portions of the casement side. Such a cylinder or drum would (in one form) be mounted on a shaft by an appropriate bushing, the shaft thus rotating the cylinder or drum and also the hands. In this broader sense therefore it should be appreciated that the frontal display need not necessarily have hands as such as instead it is possible to employ a numerical display of the time likewise through a window or some alternative means or using some appropriate indicating means.

As can be seen from the figures the drum as far as the side displays are concerned has two rows of hour numerals or the equivalent necessary. Obviously if desired the clock could be a 24 hour clock.

It can be seen therefore that the two sets of figures are reversed with respect to each other so that normal upright figures can be viewed from each side.

The casement for the rotating drum would be such that a dust free environment is provided.

It is envisaged that the casement is open on one side so that it can be placed over the drum and attached to the conventional or a conventional clock by means of a metal ring holder.

Other features of note include the provision of windows on each side sufficiently long for simultaneous readings of the time.

Figure 5:
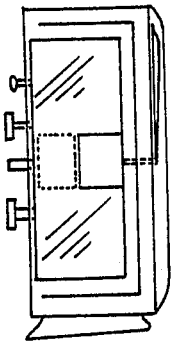
FIG. 5 is a cross-sectional view through an alternative form of the invention wherein the clock casement also forms the casement for the rotatable cylinder.
Figure 6:
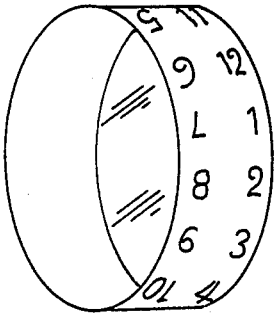
FIG. 6 is a perspective view from the back of the rotatable cylinder used in the embodiment of FIG. 5.
Figure 7:
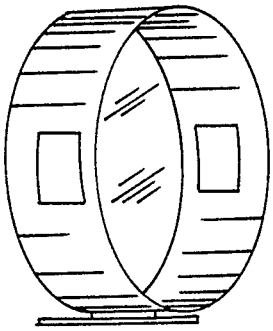
FIG. 7 is a perspective view from the front of the combined clock and cylinder casement of the embodiment of FIG. 5.
Figure 8:
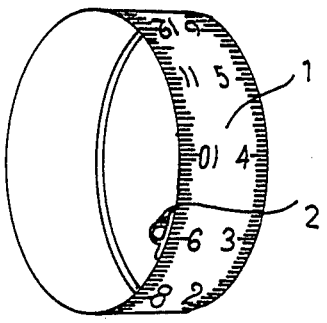
FIG. 8 is a perspective view of an element similar to that depicted in FIG. 2 but of a different kind viz., one appropriate for fitting about a normal clock mechanism to be mounted by and rotated by an engagement with an extension that moves with or synchronously with the hour hand.
Figure 9:
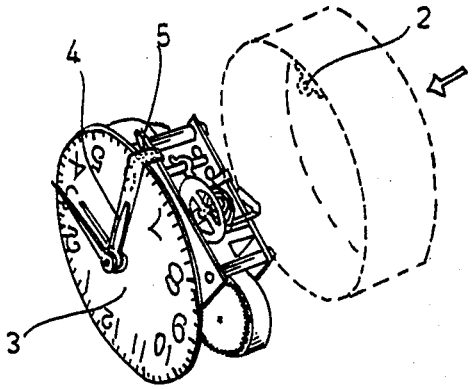
FIG. 9 is a perspective view showing a clock mechanism and in ghosted outline the arrangement of the element of FIG. 8 as it would be moved to engage with an extension which underlies the hour hand and is rotated therewith.
Figure 10:
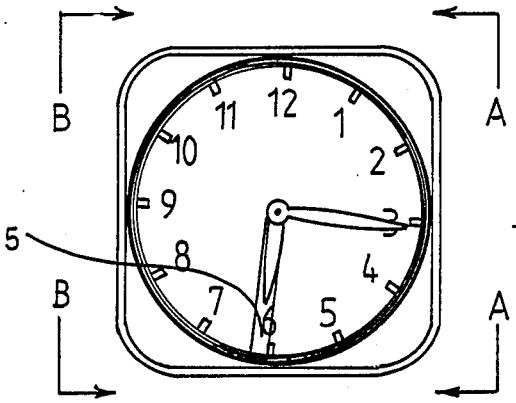
FIG. 10 is a front elevational view of the face of a clock having a mechanism as depicted in FIG. 9, the clock having a substantially square shaped housing thereabout of sufficient diameter to encompass the element of FIG. 8.
Figure 11:
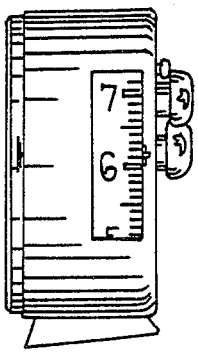
FIG. 11 is a view taken along line A—A of the assembly of FIG. 10.
Figure 12:
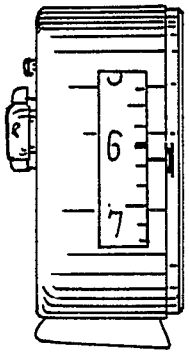
FIG. 12 is a view taken along line B—B of the assembly of FIG. 10.

FIGS. 5, 6 and 7 show an alternative embodiment of the invention wherein the casement of the clock itself also provides the casement for the rotatable cylinder, there being a window in each opposite side of the casement through which windows the rotatable cylinder, and therefore the time displayed by it can be seen from opposite sides of the clock. This clock as shown still has a conventional front face and hands displaying the time to the front of the clock.

FIGS. 8 to 12 show a different embodiment of the present invention. In this embodiment the cylindrical rotational element 1 has mounted on an inner face thereof a socket member 2 capable of engaging about the distal end region of an extended member (preferably transparent) 5 which moves with the hour hand. Indeed, if desired, it could form part of the hour hand. With such an arrangement the element 1 need simply be given room about the mechanism of the clock within its housing. As can be seen the normal clock face 3 can be read despite the fact that the hour hand 4 is associated with the extension member 5. In addition two side window arrangements allows for the simultaneous reading of the time. As can be seen the angle $\alpha$ previously referred to in the preferred embodiments is 180° such that the cylindrical element can be read at opposed positions.

Figure 1:
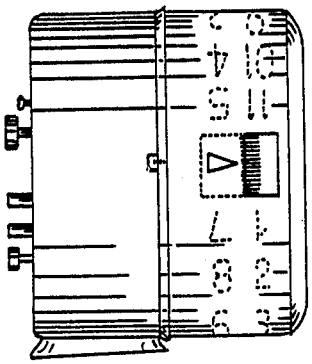
FIG. 1 is a side elevational view of a clock in accordance with the present invention, the side showing a window which displays time and yet which includes in a direction along the plane of the drawing from the right a normal hand display, there being also a similar window display on the other side of the clock which display displays the cylindrical array of figures shown in dotted outline spaced to the left of the figures to be displayed by the window.
Figure 2:
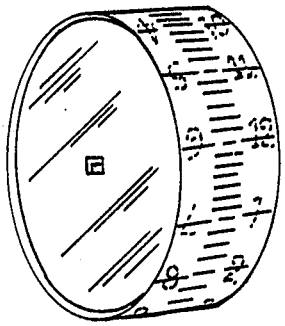
FIG. 2 is a perspective view showing a rotatable cylinder or disc which can display on either side of the clock in FIG. 1.
Figure 3:
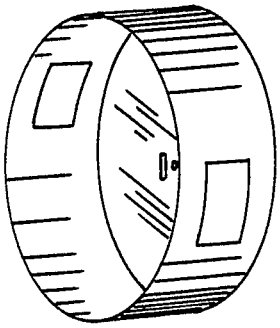
FIG. 3 is a perspective view showing the casement suitable for a clock as shown in FIG. 1, the window as such not necessarily but preferably including some dust stopping material, for example perspex, or glass.
Figure 4:
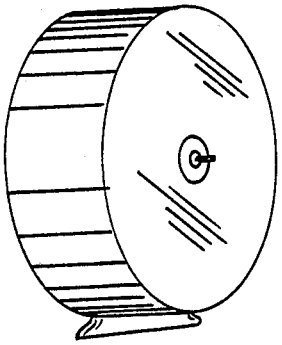
FIG. 4 is a perspective view showing the mounting onto which the disc of FIG. 2 can be mounted to be driven by the shaft (e.g. the shaft of a conventional clock)

In the embodiments shown only one rotatable cylinder is used, this being connected to the hour hand shaft. This one cylinder displays both hours and minutes, the numbers (or other indicia) on the cylinder to be read perhaps being indicated by a mark or pointer or the like marked on the outside of the casement adjacent each window or on the window itself, if on a transparent material. This is shown in FIG. 1. However, the invention could include two rotatable cylinders, one to indicate the hours and the other the minutes, the latter being mounted on the minute hand shaft.

From the foregoing therefore it can be seen that the present invention provides a novel form of clock or provides for the conversion of a conventional, mechanical or electric clock to a multi display clock by a simple fitting of the drum and casement about the hour shaft (which is preferably extended) without detracting from the use of the hour hand or other mechanical display shaft from the front direction.

The present invention therefore consists in methods of such conversion, methods of use and of course any clock or conversion apparatus providing a clock in accordance with the present invention.

What is claimed is:

1. A clock comprising a housing member, a clock face mounted within said housing, at least one rotatable shaft mounted within said housing and extending through the center of said clock face, an hour hand inserted on the end of said shaft extending through said face to be rotated by said shaft to sweep over said face, means to drive said shaft mounted within said housing, an extension on said hour hand, a cylindrical member rotatably mounted within said housing to rotate about its central axis coaxially with respect to said shaft, means to connect said cylindrical member to said extension so that said cylindrical member is rotated by said hour hand synchronously therewith, two axially spaced sets of time sequenced indicia on the outer peripheral surface of said cylindrical member, said sets being out of phase by 180° and inverted with respect to each other so that the same indicia can be read simultaneously on diametrically opposite sides of said cylindrical member, and means on said housing member adjacent said peripheral surface to indicate the same time on each one of said sets of time sequenced indicia on opposite sides of said housing member simultaneously and coinciding with the time indicated on said clock face.

2. A clock as claimed in claim 1 wherein said extension on said hour hand is transparent and extends substantially radially from the distal end thereof.

3. A clock as claimed in claim 2 wherein said extension on said hour hand passes over the peripheral edge of said clock face in spaced relation, and said means to connect said cylindrical member to said extension comprises a socket member on the inner surface of said cylindrical member adapted to engage about the distal end of said extension.

4. A clock as claimed in claim 3 wherein said time indicating means on said housing member comprises windows on diametrically opposite sides of said housing member through which can be read one of said sets of time sequenced indicia and a mark on said housing to point to said indicia.

* * * * *